US008657725B2

(12) United States Patent
Mechling et al.

(10) Patent No.: US 8,657,725 B2
(45) Date of Patent: Feb. 25, 2014

(54) CONVERTIBLE FIGHT SIMULATION DUMMY

(75) Inventors: Christopher Mechling, San Diego, CA (US); Nicholas Mechling, San Diego, CA (US)

(73) Assignee: Twins Special, LLC, San Diego, CA (US)

( * ) Notice: Subject to any disclaimer, the term of this patent is extended or adjusted under 35 U.S.C. 154(b) by 188 days.

(21) Appl. No.: 13/353,228

(22) Filed: Jan. 18, 2012

(65) Prior Publication Data

US 2013/0017931 A1 Jan. 17, 2013

Related U.S. Application Data

(60) Provisional application No. 61/433,841, filed on Jan. 18, 2011, provisional application No. 61/473,378, filed on Apr. 8, 2011.

(51) Int. Cl.
*A63B 21/00* (2006.01)

(52) U.S. Cl.
USPC ..... 482/83; 482/87; 482/90

(58) Field of Classification Search
USPC ..... 482/83, 84, 85, 86, 87, 88, 89, 90
See application file for complete search history.

(56) References Cited

U.S. PATENT DOCUMENTS

| | | | | |
|---|---|---|---|---|
| 519,918 | A * | 5/1894 | MacLearn | 482/90 |
| 1,446,835 | A * | 2/1923 | Cook | 446/227 |
| 2,184,453 | A * | 12/1939 | Hayes | 482/90 |
| 3,022,072 | A * | 2/1962 | Zinnow | 482/90 |
| 6,398,697 | B1 * | 6/2002 | Nichols, Jr. | 482/87 |
| 7,704,194 | B1 * | 4/2010 | Chen | 482/87 |
| 8,371,995 | B2 * | 2/2013 | Crawford | 482/83 |
| 2011/0251024 | A1 * | 10/2011 | Hu | 482/90 |

* cited by examiner

*Primary Examiner* — Jerome w Donnelly
(74) *Attorney, Agent, or Firm* — Lewis Kohn & Fitzwilliam LLP; David M. Kohn

(57) ABSTRACT

An attack dummy is convertible between a strike dummy and a grappling dummy by exchanging a bottom portion adapted for a strike dummy for a bottom portion adapted for a grappling dummy.

12 Claims, 8 Drawing Sheets

CONVERTIBLE FIGHT SIMULATION DUMMY

PRIORITY CLAIM

This application claims benefit of the priority dates of U.S. Provisional Patent Application Ser. Nos. 61/433,841 and 61/473,378, incorporated herein by reference.

FIELD OF THE INVENTION

The invention relates to fight simulation dummies employable for fight training, including strike dummies and grappling dummies. More particularly, the invention relates to fight simulation dummies capable of structural conversion between being a strike dummy and a grappling dummy.

BACKGROUND

Fight simulation dummies are employed for training in many fight simulation scenarios. Different fight simulation dummies are required for different fight simulation scenarios. Unfortunately, the same dummy is usually not employable in multiple fight scenarios.

What is needed is a fight simulation dummy capable of being structurally converted between multiple dummy types.

SUMMARY

A first aspect of the invention is directed to an attack dummy (1) that is convertible between a strike dummy (2) and a grappling dummy (3). One embodiment of this first aspect is directed to a attack dummy (1) the comprises an attack object (4), a non-attack object (5), and a core post (6) for coupling and uncoupling the attack object (4) to and from the non-attack object (5). The attack object (4) may be employed for either striking or grappling. The attack object (4) has a top portion (7) and a bottom portion (8). The bottom portion (8) defines a flat bottom surface (9). The attack object (4) defines a core hole (10) opening onto the flat bottom surface (9) and extending through the bottom portion (8) toward the top portion (7). The non-attack object (5) is selected from a group consisting of a bottom portion (8) of the strike dummy (2) and a bottom portion (8) of the grappling dummy (3). The non-attack object (5) includes a screw hole (11). The core post (6) is employed for coupling and uncoupling the attack object (4) to and from non-attack object (5). The core post (6) includes a first section (12), a second section (13), and a joint section (14). The joint section (14) is disposed between the first and second sections (12 & 13) and serves to join the first and second sections (12 & 13) to one another. The core post (6) defines a hollow interior space extending through the first, second, and joint sections (12, 13, & 14). The first section (12) of the core post (6) has a shape substantially congruent with the core hole (10) of the attack object (4) and is disposed and affixed therein for imparting relative rigidity to the bottom portion (8) of the attack object (4) without imparting substantially enhanced rigidity to the top portion (7) of the attack object (4). The first section (12) includes one or more vertical ridges (15) extending radially therefrom for rotationally fixing the core post (6) within the core hole (10). The joint section (14) of the core post (6) is disposed substantially flush with the flat bottom surface (9) of the attack object (4). The second section (13) of the core post (6) extends outwardly from the flat bottom surface (9) of the attack object (4). The second section (13) is cylindrical and including a terminus (16) distal from the first section (12). The second section (13) includes concentrically disposed screw threads (17) for coupling and uncoupling to the screw hole (11) of the non-attack object (5). The terminus (16) of the second section (13) defines a port hole (18) for transferring optional weight material to or from the hollow interior space of the core post (6). The port hole (18) further includes an optional cap (19) for closing the port hole (18). Whereby, the attack dummy (1) can be converted to either the strike dummy (2) or the grappling dummy (3) by reversible attachment of the attack object (4) to the appropriate non-attack object (5) by means of the core post (6).

A second embodiment of the first aspect of the invention incorporates the first embodiment, as described above, and further comprises a spacer (20) positionable between the attack object (4) and the non-attack object (5) for increasing the overall length of the attack dummy (1). The spacer (20) has a screw hole (21) for coupling and uncoupling with the second section (13) of the core post (6). The spacer (20) includes a flat top surface (22). The spacer (20), when coupled to the second section (13) of the core post (6) with the flat top surface (22) facing and abutting against the flat bottom surface (9) of the bottom portion (8) of the attack object (4), conforms in shape with the attack object (4) for maintaining striking and grappling characteristics of the attack object (4).

A third embodiment of the first aspect of the invention incorporates the first and/or second embodiments, as described above, wherein the attack object (4) is selected from a group consisting of a mannequin (23) and a bag (24) for striking or grappling. In a preferred embodiment, the attack object (4) is a mannequin (23). In another preferred embodiment, the mannequin (23) includes an arm (25) attached thereto. In another preferred embodiment, the mannequin (23) includes an articulated ball joint (26) for attaching the arm (25) to the mannequin (23). In another preferred embodiment, the mannequin (23) includes a jacket (27) affixed thereon. In another preferred embodiment, the non-attack object (5) is a conically shaped stand (28) for supporting the attack object (4) in a stable upright strike stance. In another preferred embodiment, the conically shaped stand (28) is hollow and includes a port (29) for transferring optional weight material to or from the hollow space. In another preferred embodiment, the non-attack object (5) is a capsule (30) disposing the attack object (4) in a non-upright grappling stance. In another preferred embodiment, the non-attack object (5) is a capsule having three or more feet (31) for disposing the attack object (4) in an upright grappling stance of low stability.

A second aspect of the invention is directed an improved method for manufacturing an attack dummy (1). The improvement comprises the step of affixing a core post (6) within a hole in an attach object by means of glue for making the attack dummy (1) according to the first aspect of the invention, described above.

DETAILED DESCRIPTION

Figure 1A:
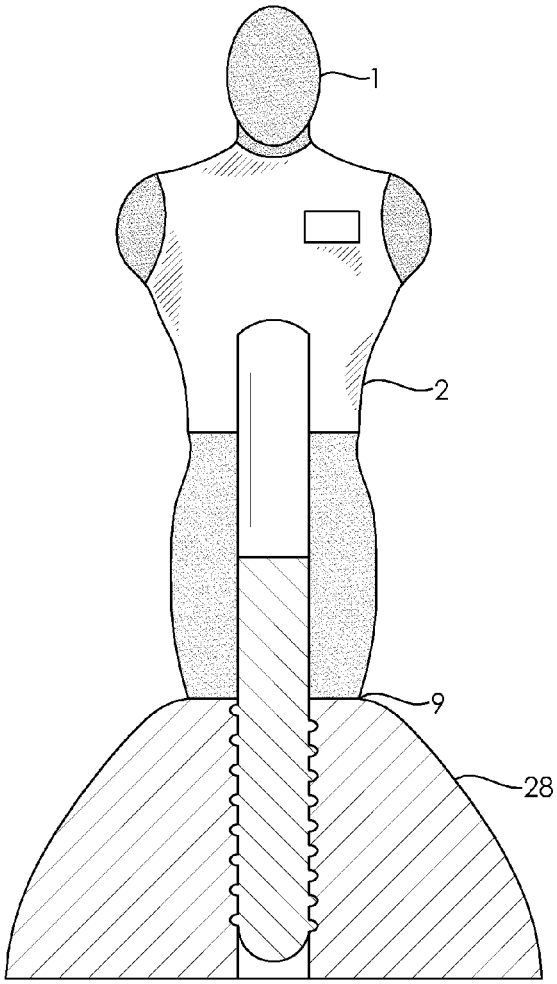
FIG. 1 illustrates an strike type attack dummy with and without a spacer. The lower portion of FIG. 1 is sectional and illustrates the central post. The upper portion of FIG. 1 is perspective.
Figure 1B:
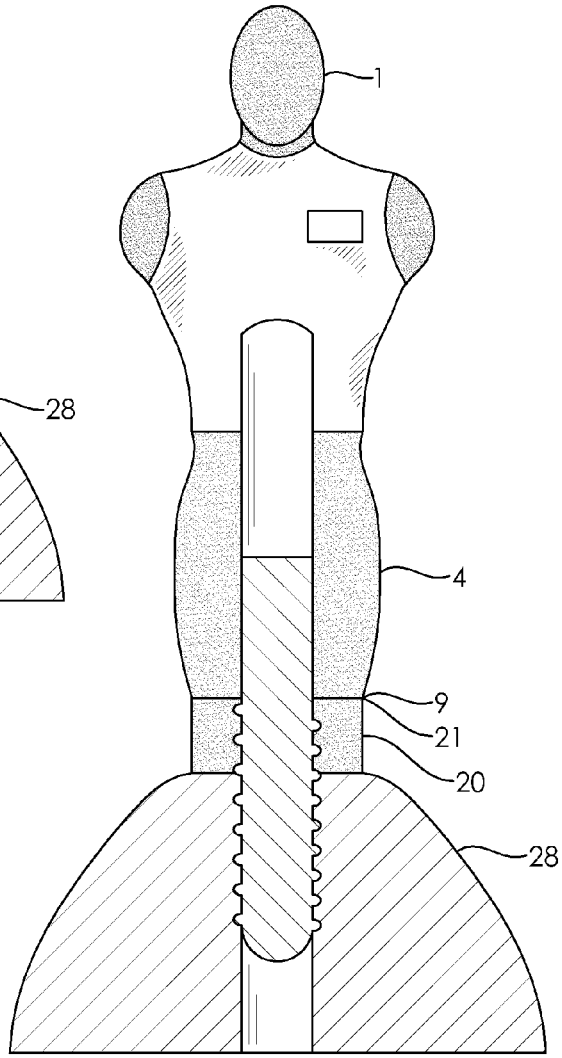
Figure 2:
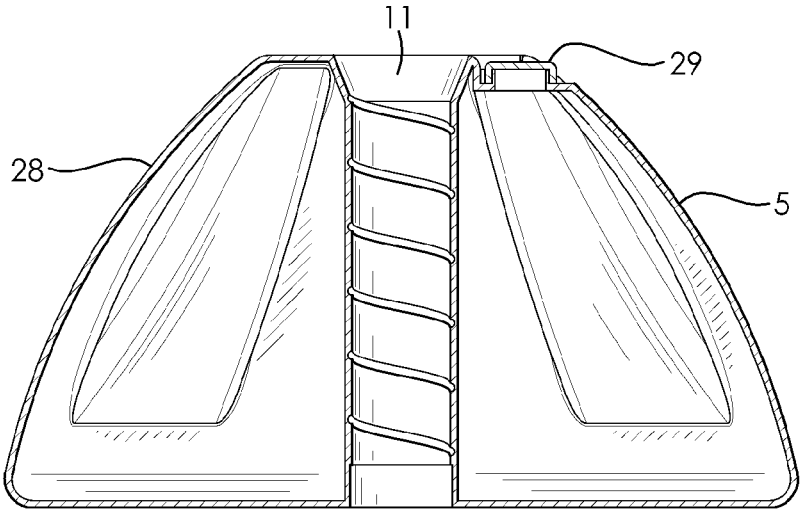
FIG. 2 illustrates an enlarged sectional view of the conical stand of FIG. 1.
Figure 3:
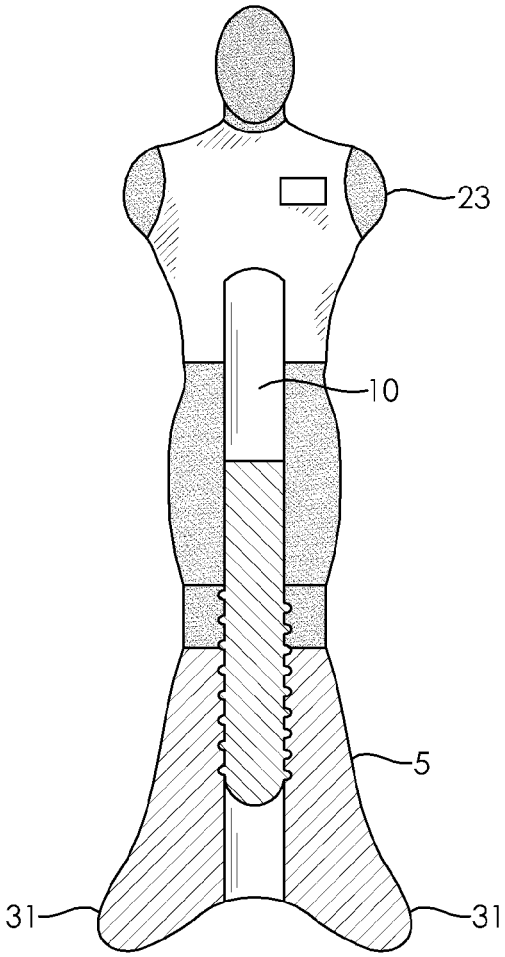
FIG. 3 illustrates an attack dummy with three feet.
Figure 4:
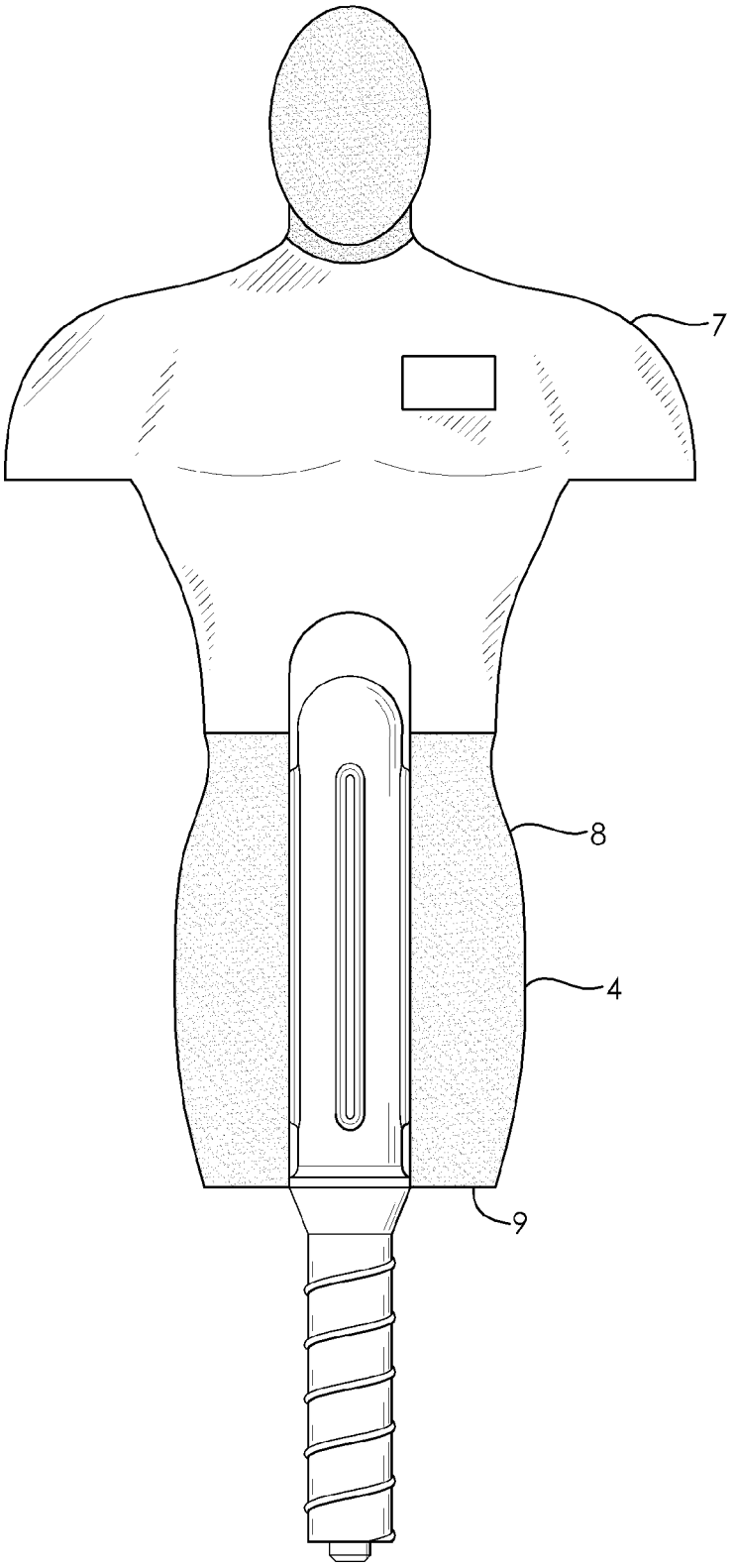
FIG. 4 illustrates the attack dummy of FIG. 3 with the post inside.
Figure 5A:
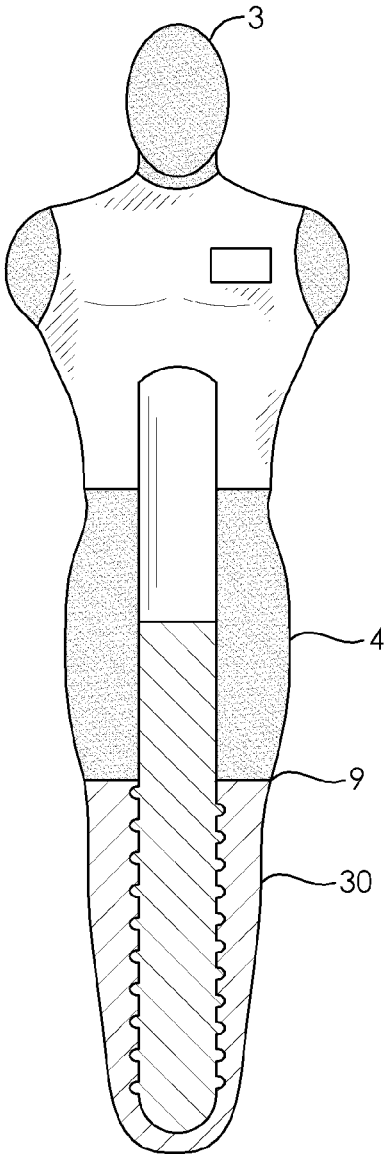
FIG. 5 illustrate a grappling type attack dummy, with and without a spacer.
Figure 5B:
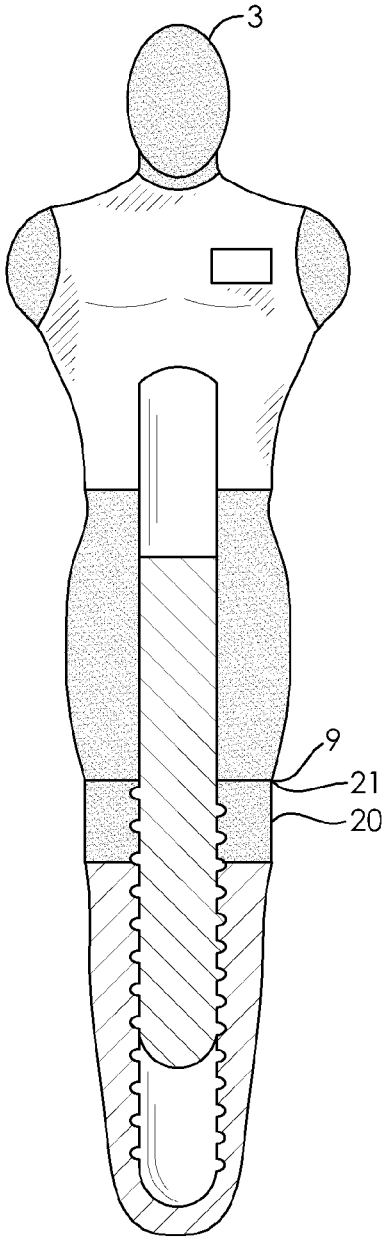
Figure 6A:
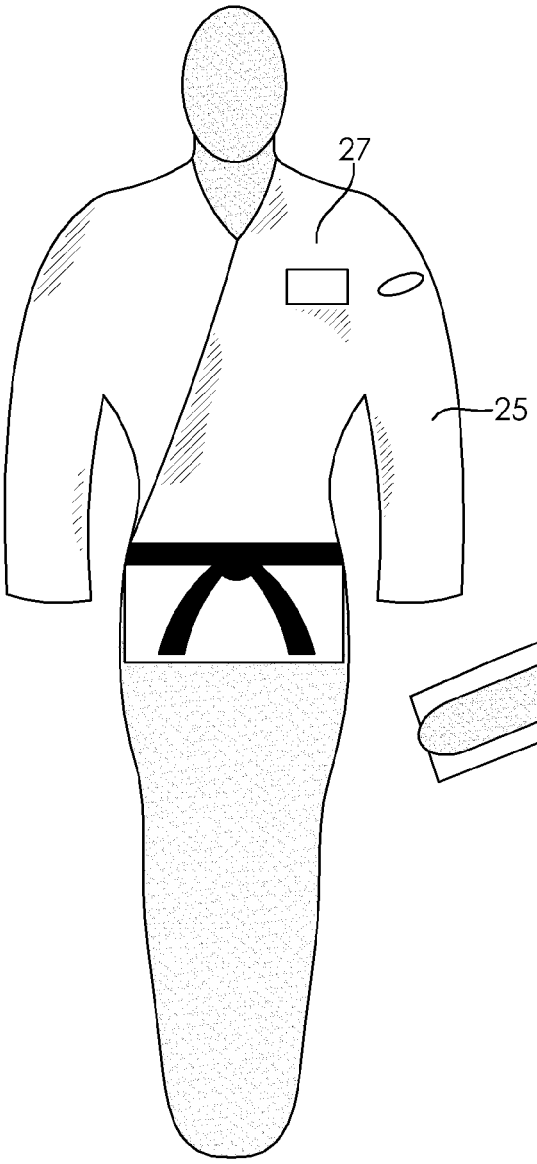
FIG. 6. Illustrates the grappling type attack dummy of FIG. 5, with a coat, and with and without an articulated ball joint arm.
Figure 6B:
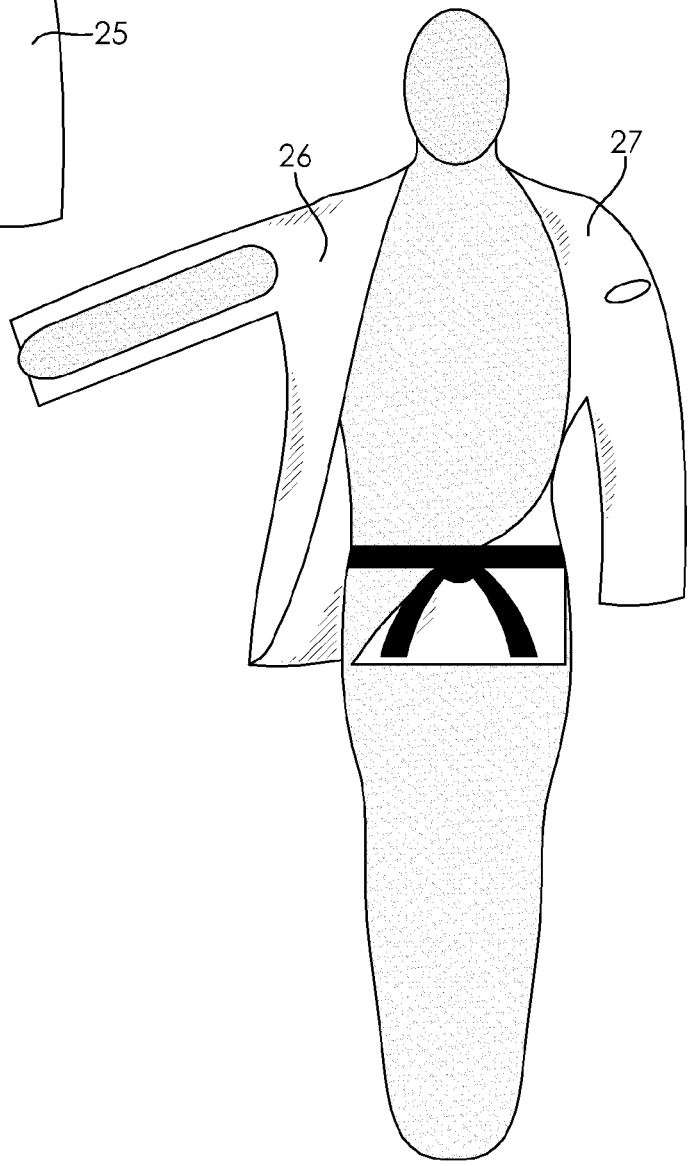
Figure 7:
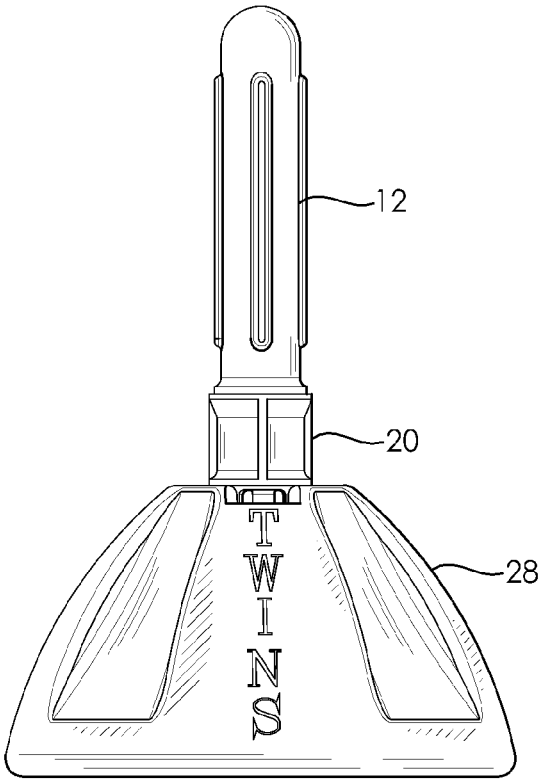
FIG. 7 illustrates a conical stand with a portion or a spacer and an inserted post. Note that the post lacks its attack object to which it would normally be permanently attached. Additionally, the portion of the spacer does not illustrate the fill material that normally extends from it.
Figure 8:
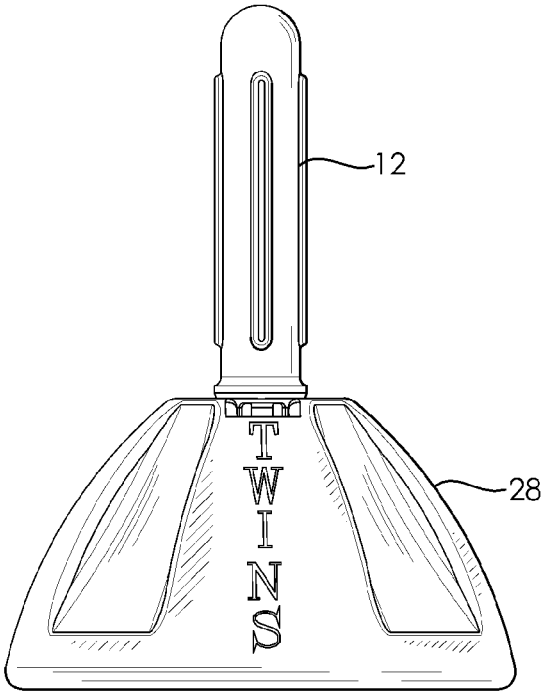
FIG. 8 is the same and FIG. 7, except the spacer is omitted.
Figure 9:
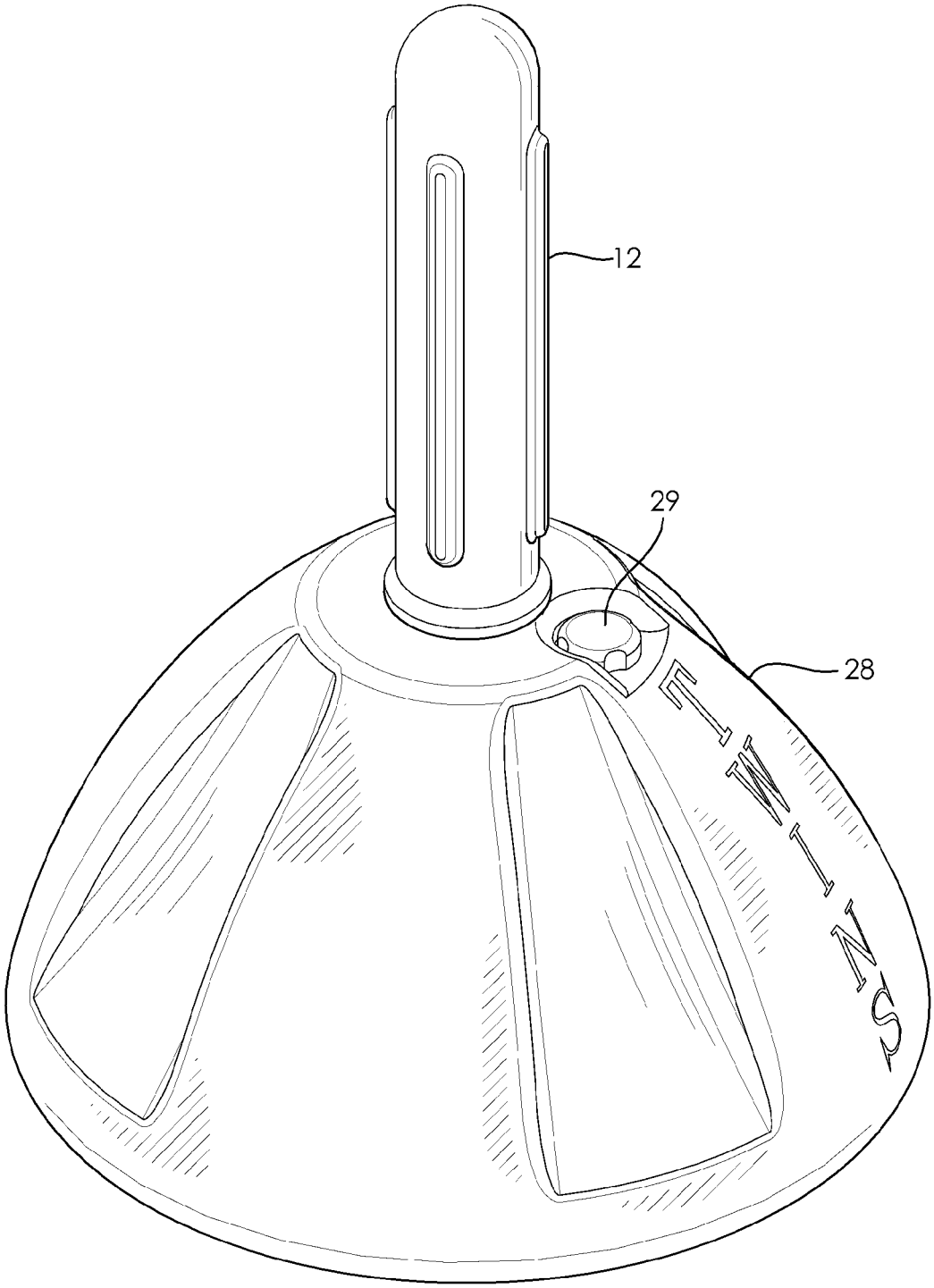
FIG. 9 is a perspective view of the conical stand of FIG. 8.
Figure 10:
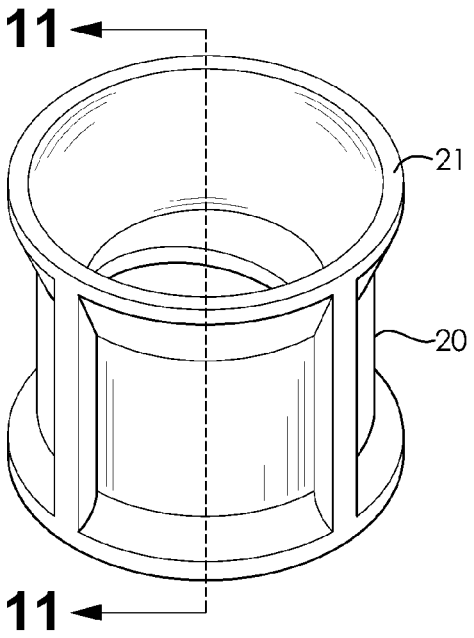
FIG. 10 is perspective view of the screw-on spacer attachment shown in FIG. 5B.
Figure 11:
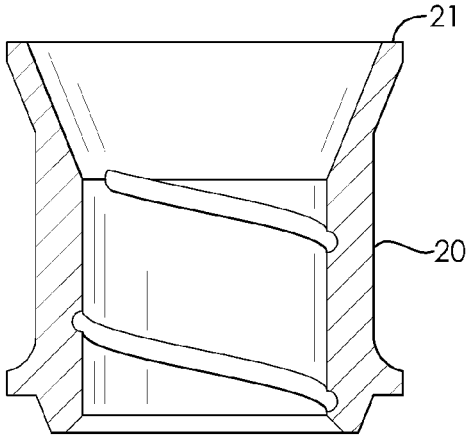
FIG. 11 is a cross-section of the screw-on spacer attachment shown in FIG. 10.
Figure 12:
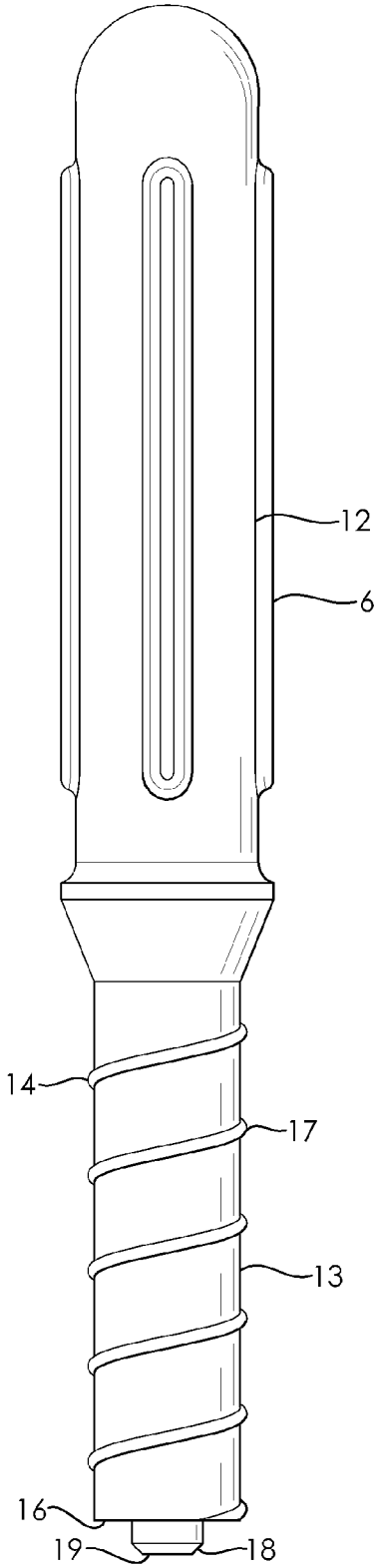
FIG. 12 is a side view of the core post inside the attack dummy without the foam structure shown in FIG. 1-6.

The device is an attack dummy (1) for fight simulation. The devise is designed to serve as a multi-function training aid. In the core there is a round post (6), the first section (12) of which fits inside a foam structure (4) modeled after the human body (23) and is affixed thereto. If additional weight is required for the dummy (1), the post (6) is hollow and includes a port hole (18) for enabling the post (6) to be filled with sand or other weight providing materials. Leather (or a synthetic leather material) covers the surface of this foam structure (4) and the upper portion of the structure (7) may be molded to include a human likeness or other features. At the bottom portion (8) of the foam body structure (4), approximately where the knees would be, a second section of the post (13) extends further.

The foam body structure (4) may be made with or without arms (25), depending on the intended use. If the foam body structure has arms (25), they may be formed in a particular pose, or they may be poseable. Poseable arms (25) may include a ball joint (26) design at the shoulder and/or elbow.

The portion of the post not covered by the foam body structure, i.e., the second section (13), is made with a screw thread design (17). This allows it to be screwed into various attachments (5) that serve different training purposes.

For example, there is a hollow cone-like base attachment (28) that can be filled with water or sand via a port hole (29) so as to enhance the upright stability to the device, enabling it to be used as a free-standing punching bag (2). The cone-like design of this attachment allows for a wide ground foot print while clearing the way for a low, rising kick to reach up to the foam body structure of the core. A cylinder-like design would significant limit the angles where a kick can be delivered to the core. Additionally, the side surface of the cone-like base attachment is padded with foam, so it can also be kicked.

Another screw-on attachment (30) is capsule-like, enabling the product to be used as a grappling dummy (3). The capsule (30) does not help the product to stand, as the intended use is for practicing body-throws and ground-grappling techniques). All exterior surfaces of the capsule-like attachment are covered in foam to protect the user from contact with the hard surface of post during training.

Another screw-on attachment is a modification of the capsule-like design. Again the exterior of the attachment is completely covered in foam. In this case, however, the foam extends out in three directions at its base (31), providing some measure of stability. The purpose of this attachment is to add stability to the bag while it is used as a grappling dummy, making the bag more resistant to falling when standing, or rolling when on the ground.

Another screw-on attachment is cylinder-shaped and padded and serves as a spacer (20). It has two open-ends (21), allowing it to screw onto the second section (13) of the post (6) in the same way that a nut screws onto a bolt, leaving the end of the second section (13) of the post (6) still exposed. This would allow another attachment (5), such as the cone-like attachment (28) to screw onto the end (13) of the post (6). The purpose of this nut-like attachment is extend the top of the bag (4) further from its base (5), simulating a taller opponent, while ensuring the entire length of the post is covered with padding.

Additionally, the product may be used with accessories such as a special jacket (27). An example would be a jacket with special straps to secure it to the body structure, and foam arms inside the sleeves.

EXAMPLE

Key features of the Example include:

1. The device is a multi-function, realistic training dummy (1) for striking and grappling techniques, with a rigid post (6) inside glued to the internal padding.
2. The lower section (13) of the internal post has a screw structure (17) that allows it to mount on various attachments (5) including a standing base (28), for striking practice, and a padded grappling capsule (30), for throwing and ground-fighting practice.
3. The internal post is hollow, and has a screw cap (18) at its bottom (16), allowing the post to be filled with sand for extra weight.
4. Due to vertical ridges (15) on the internal post (12), the dummy will not slide or move on its post (6).
5. The fully padded dummy (2) includes multi-density multi-layer foam inside to protect the hands and feet while striking. Core padding is made of high density foam, allowing the dummy (1) to absorb impacts and maintain its structure and shape.
6. Standing base and padded grappling capsule accessories are included in the complete set.
7. A durable covering over foam structure is molded to show human features.
8. The device (1) is resistant to strikes from training weapons
9. The dummy is the approximate size of a large American male while standing or on the ground.
10. The shoulder structure is shaped to support practiced of throwing techniques.
11. The dummy stands 5'6" without the padded height extension accessory.
12. The padded height extension accessory included in complete set adds 6 inches of height, making the dummy stand 6 feet tall.
13. The standing base allows for 360 degree simulations of standing combat scenarios.
14. The standing base can be filled with water or sand (Volume is approximately 38 gallons). Filled with water, the base will weigh up to 330 lbs.

What is claimed is:

1. An attack dummy, the attach dummy being convertible between a strike dummy and a grappling dummy, the attack dummy comprising, an attack object for striking or grappling, the attack object having a top portion and a bottom portion, the bottom portion defining a flat bottom surface, the attack object defining a core hole opening onto the bottom surface and extending through the bottom portion toward the top portion;

a non-attack object being selected from a group consisting of a bottom portion of the strike dummy and a bottom portion of the grappling dummy, the non-attack object including a screw hole; and a core post for coupling and uncoupling the attack object to and from non-attack object, the core post including a first section, a second section, and a joint section, the joint section disposed between the first and second sections and serving to join the first and second sections, the core post defining a hollow interior space extending through the first, second, and joint sections, the first section of the core post having a shape substantially congruent with the core hole of the attack object and being disposed and affixed therein for imparting relative rigidity to the bottom portion of the attack object without imparting substantially enhanced rigidity to the top portion of the attack object, the first section including one or more vertical ridges extending radially therefrom for rotationally fixing the core post within the core hole;

the joint section of the core post being disposed substantially flush with the bottom surface of the attack object, the second section of the core post extending outwardly from the bottom surface of the attack object, the second section being cylindrical and including a terminus distal from the first section, the second section including concentrically disposed screw threads for coupling and uncoupling with the screw hole of the non-attack object, the terminus of the second section defining a port hole for transferring optional weight material to or from the hollow interior space of the core post, the port hole further including an optional cap for closing the port hole;

whereby, the attack dummy can be converted to either the strike dummy or the grappling dummy by reversible attachment of the attack object to the appropriate non-attack object by means of the core post.

2. The dummy of claim 1 further comprising a spacer positionable between the attack object and the non-attack object for increasing the overall length of the attack dummy, the spacer having a screw hole for coupling and uncoupling with the second section of the core post, the spacer includes a flat top surface, the spacer, when coupled to the second section of the core post with the flat top surface facing and abutting against the flat bottom surface of the bottom portion of the attack object, conforming in shape with the attack object for maintaining striking and grappling characteristics of the attack object.

3. The dummy of claim 1 wherein the attack object is selected from a group consisting of a mannequin and a bag for striking or grappling.

4. The dummy of claim 3 wherein the attack object is a mannequin.

5. The dummy of claim 4 wherein the mannequin includes an arm attached thereto.

6. The dummy of claim 5 wherein the mannequin includes an articulated ball joint for attaching the arm to the mannequin.

7. The dummy of claim 4 wherein the mannequin includes a jacket affixed thereon.

8. The dummy of claim 1 wherein the non-attack object is a conically shaped stand for supporting the attack object in a stable upright strike stance.

9. The dummy of claim 8 wherein the conically shaped stand is hollow and includes a port for transferring optional weight material to or from the hollow space.

10. The dummy of claim 1 wherein the non-attack object is a capsule disposing the attack object in a non-upright grappling stance.

11. The dummy of claim 1 wherein the non-attack object is a capsule having three or more feet for disposing the attack object in an upright grappling stance of low stability.

12. An improved method for manufacturing an attack dummy, wherein the improvement comprises the step of affixing a core post within a hole in an attach object by means of glue for making the attack dummy according to claim 1.

* * * * *